US006227949B1

(12) United States Patent
Yi et al.

(10) Patent No.: US 6,227,949 B1
(45) Date of Patent: May 8, 2001

(54) TWO-SLURRY CMP POLISHING WITH DIFFERENT PARTICLE SIZE ABRASIVES

(75) Inventors: Champion Yi, Hsinchu Hsien; Rurng-Chien Chang, Kao-Hsiung; Jiun-Fang Wang, Hsin-chu, all of (TW)

(73) Assignee: ProMOS Technologies, Inc., Hsinchu (TW)

( * ) Notice: Subject to any disclaimer, the term of this patent is extended or adjusted under 35 U.S.C. 154(b) by 0 days.

(21) Appl. No.: 09/326,146

(22) Filed: Jun. 3, 1999

(51) Int. Cl.[7] ..... B24B 1/00
(52) U.S. Cl. ..... 451/57; 451/41; 216/88
(58) Field of Search ..... 451/41, 57, 285–287; 438/692, 693; 216/88, 89

(56) References Cited

U.S. PATENT DOCUMENTS 5,503,592 * 4/1996 Neumann ..... 451/57
5,571,373 * 11/1996 Krishna et al. ..... 156/636.1
5,676,587 * 10/1997 Landers et al. ..... 451/57
5,954,997 * 9/1999 Kaufman et al. ..... 252/79.1
5,961,372 * 10/1999 Shendon ..... 451/41
5,985,755 * 11/1999 Bajaj et al. ..... 451/57
6,062,952 * 5/2000 Robinson et al. ..... 451/57

* cited by examiner

*Primary Examiner*—Joseph J. Hail, III
*Assistant Examiner*—George Nguyen
(74) *Attorney, Agent, or Firm*—Blakely Sokoloff Taylor & Zafman LLP

(57) ABSTRACT

A method for chemical mechanical polishing (CMP) of a wafer having a top layer to be polished is disclosed. The method comprises the steps of: using a CMP apparatus to polish the top layer using a first slurry having abrasive particles of a first size; and using the CMP apparatus to polish the top layer using a second slurry having abrasive particles of a second size, the second size being smaller than the first size.

5 Claims, 2 Drawing Sheets

TWO-SLURRY CMP POLISHING WITH DIFFERENT PARTICLE SIZE ABRASIVES

FIELD OF THE INVENTION

The present invention relates to a chemical mechanical polishing process used in semiconductor fabrication, and more particularly, to a two-step chemical mechanical polishing process.

BACKGROUND OF THE INVENTION

During the manufacture of multilayer integrated circuits, it is desirable to effect planarization of the integrated circuit structures in the form of semiconductor wafers. This is usually accomplished by chemical mechanical polishing (CMP). FIG. 1 shows a cross-sectional view of a conventional CMP apparatus 10, which includes a rotating table 12 having a polishing pad 14 disposed thereon, and a wafer carrier 16 that holds a wafer 18. The wafer 18 is held in an inverted position against the polishing pad 14, with the side to be polished against the polishing pad. A predetermined pressure is exerted on the wafer 18 against the polishing pad 14. As shown in FIG. 2, an enlarged cross-sectional view, a slurry 19 is applied between the wafer 18 and the polishing pad 14. In operation, the polishing pad 14 and the wafer 18 rotate in relation to one another. The wafer is polished by mechanical abrasion from the polishing pad 14 and particles in the slurry 19 and by chemical action from the slurry 19 on the polishing pad 14. Apparatus for polishing semiconductor wafers are well-known in the art. Such planarization apparatus are manufactured by IPEC Planar and SpeedFam Corporation among others.

In a typical CMP process, two polishing pads are used. The semiconductor wafer is first polished by using a hard pad on a primary rotating table. The hard pad increases the planarity of the wafer. The wafer is then polished by using a soft pad and a lower downward force on a secondary rotating table. The soft pad increases the uniformity of the wafer. During the CMP process, the CMP apparatus will generate, either chemically or mechanically, unwanted particles that degrade the performance of the circuits. When the wafer is transferred from the primary table to the secondary table, the slurry becomes dry and hard due to contact with the air. A cleaning step is required. The cleaning step may include scrubbing, rinsing and spin-drying. This cleaning step undesirably reduces production efficiency. Moreover, the transferring of the wafer between the primary table and the secondary table creates the potential for contamination of the clean environment necessary during wafer fabrication.

There are also several different types of slurries used in the CMP process. The most common abrasives used are silica ($SiO_2$), alumina ($Al_2O_3$), ceria ($CeO_2$), titania ($TiO_2$), and zirconia ($ZrO_2$). The abrasives are formed using two different methods that result in fumed and colloidal abrasives. Fumed abrasives tend to be chained particles that are larger in size than colloidal abrasives, which consist of discrete particles in a dispersion. For the same solids concentration, the removal rate using a fumed abrasive is higher than that using a colloidal abrasive due to larger particle size. For the same reason, the defect density using a fumed abrasive is also higher.

For this reason, the colloidal abrasive having a uniform particle size is preferred. However, to achieve the same removal rate as using a fumed abrasive, the solids concentration of a colloidal slurry must be almost three times higher. This increases the cost of the slurry.

Thus, what is needed is a method of CMP that has a low slurry cost, a high throughput rate, and a low defect rate.

SUMMARY OF THE INVENTION

A method for chemical mechanical polishing (CMP) of a wafer having a top layer to be polished, said CMP being performed on a CMP apparatus, is disclosed. The method comprises the steps of: using said CMP apparatus to polish said top layer using a first slurry having abrasive particles of a first size; and using said CMP apparatus to polish said top layer using a second slurry having abrasive particles of a second size, said second size being smaller than said first size.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention will be described in detail with reference to the accompanying drawings. In short, the present invention uses two different slurries while using the same polishing pad and apparatus. In particular, in the present invention, the traditional prior art one-step polishing with either colloidal or fumed abrasive slurry is replaced by two steps with two different types of slurries using only one planarizing hard pad without need for final buffing.

Figure 1:
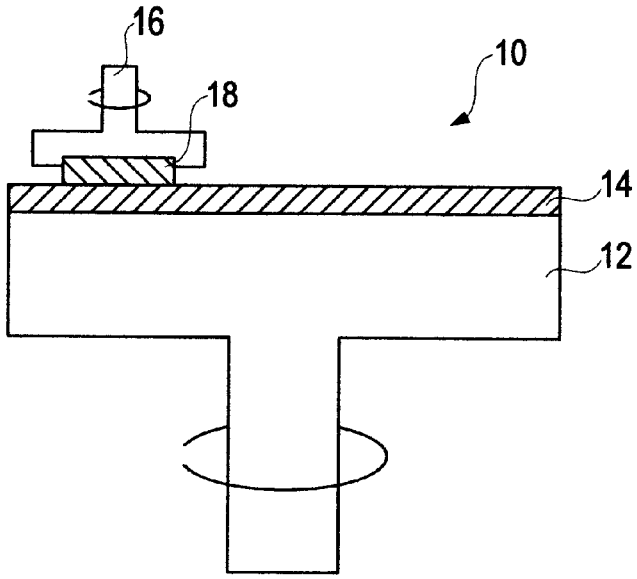
FIGURE 1 (PRIOR ART)
FIG. 1 is a cross-sectional view of a conventional CMP apparatus.
Figure 2:
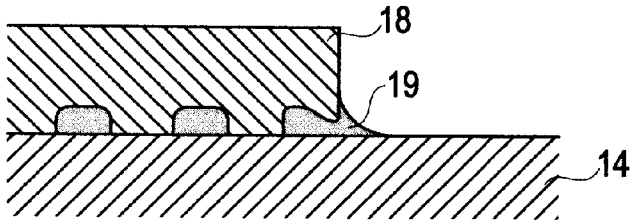
FIGURE 2 (PRIOR ART)
FIG. 2 is an enlarged cross-sectional view of a portion of the conventional CMP apparatus shown in FIG. 1.
Figure 3:
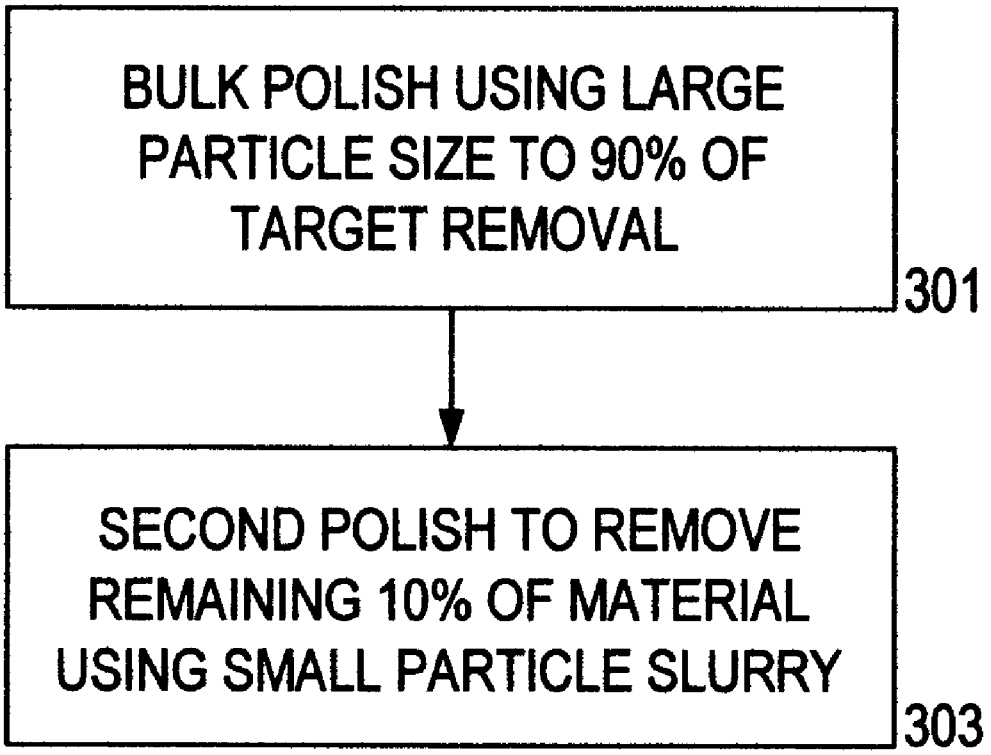
FIG. 3 is a flow chart illustrating the steps of polishing a wafer using the method of the present invention.

FIG. 3 shows a flow diagram illustrating the method of the present invention. In the preferred embodiment, the polishing pad used by the CMP apparatus is a Rodel IC1000 pad, although any hard pad will also be acceptable. As seen in FIG. 1, the wafer carrier 16 positions the semiconductor wafer 18 against the polishing pad 14. At step 301, the wafer is polished against the polishing pad 14 using a first slurry. The first slurry has a relatively large particle size. Preferably, the abrasive particles in the first slurry are of the fumed variety and have a mean size of greater than 100 nm in dispersion. As noted above, this type of slurry is relatively inexpensive. Moreover, the first polish step is continued until approximately 90% of the target removal has been accomplished. This first polish is also referred to as the "bulk polish".

Next, at step 303, using the same polishing pad and in the same apparatus, the polishing slurry is changed. In particular, a colloidal abrasive slurry is used where preferably the mean particle size is on the order of 10 to 100 nm. The second polish is performed until the remaining 10% of the target removal thickness is completed.

Note that the present invention may be used for CMP of oxides (TEOS, BPSG, HDP) or on metal layers (W, Al, Cu).

There are several advantages of the present invention over the prior art. In the first "bulk polish" step, the cost of the slurry having relatively large fumed particles is lower than the smaller colloidal slurries. Moreover, the removal rate using the fumed slurry is higher, thereby increasing throughput.

By changing over to a finer slurry polish in the second step, less defects are generated on the wafer surface. The second polish also serves the purpose of repairing defects caused by the "bulk polish" step. Additionally, the final buffing step or buffing pad is no longer required. Note that in the present invention, the entire CMP process is performed using a single polishing pad. This increases throughput and lowers cost. Additionally, the lower removal rate of the second polish step increases the process window for within wafer uniformity control and for better planarity control (less oxide dishing).

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for chemical mechanical polishing (CMP) of a wafer having a top layer to be polished, said CMP being performed on a CMP apparatus, the method comprising the steps of:

performing a first polishing step using said CMP apparatus to polish said top layer using a first slurry comprising fumed abrasive particles of a first size; and performing a second polishing step using said CMP apparatus to polish said top layer using a second slurry comprising colloidal abrasive particles of a second size, said second size being smaller than said first size;

wherein said first polishing step and said second polishing step is performed on one polishing pad.

2. The method of claim 1, wherein said first slurry has fumed abrasive particles having a mean size of greater than 100 nm.

3. The method of claim 1 wherein said second slurry has colloidal particles having a mean size of between 10 and 100 nm.

4. The method of claim 1 wherein said first polishing step is performed until approximately 90 percent of a desired polish thickness is removed.

5. The method of claim 4 wherein said second polishing step is performed until approximately 10 percent of a desired polish thickness is removed.

* * * * *